United States Patent [19]

Iizuka

[11] Patent Number: 4,819,605

[45] Date of Patent: Apr. 11, 1989

[54] FUEL INJECTION CONTROL SYSTEM FOR AN AUTOMOTIVE ENGINE

[75] Inventor: Tsunee Iizuka, Hohya, Japan

[73] Assignee: Fuji Jukogyo Kabushiki Kaisha, Tokyo, Japan

[21] Appl. No.: 173,364

[22] Filed: Mar. 25, 1988

[30] Foreign Application Priority Data

Apr. 2, 1987 [JP] Japan ..... 62-081596

[51] Int. Cl.[4] ..... F02D 5/00; F02D 17/00; F02B 3/10

[52] U.S. Cl. ..... 123/492; 364/431.07

[58] Field of Search ..... 123/492, 493, 478, 480, 123/486; 364/431.07

[56] References Cited

U.S. PATENT DOCUMENTS 4,305,365 12/1981 Iizuka et al. ..... 123/492
4,490,792 12/1984 Deutsch et al. ..... 123/492
4,527,521 7/1985 Hasagawa et al. ..... 123/493
4,527,529 7/1985 Suzuki et al. ..... 123/492
4,543,937 10/1985 Amano et al. ..... 123/491
4,730,587 3/1988 Norota et al. ..... 123/493

*Primary Examiner*—Raymond A. Nelli
*Attorney, Agent, or Firm*—Martin A. Farber

[57] ABSTRACT

A fuel injection control system has a detector for detecting acceleration of an engine and for producing an acceleration signal, an air-conditioner switch for producing an air-conditioner signal when the air-conditioner switch is closed. An auxiliary injection signal generator is provided for producing an auxiliary injection pulse width first signal in response to the acceleration signal and air-conditioner signal. The first signal is injected by the auxiliary injection pulse width when the acceleration signal is detected. The auxiliary injection pulse width first signal has a smaller value than a second signal when the air-conditioner switch is opened, thereby reducing auxiliary injection pulse width.

4 Claims, 5 Drawing Sheets

FUEL INJECTION CONTROL SYSTEM FOR AN AUTOMOTIVE ENGINE

BACKGROUND OF THE INVENTION

The present invention relates to a fuel injection system for controlling air-fuel ratio of mixture supplied to an engine of a vehicle, and more particularly to a control system for injecting an interrupt fuel during an ordinary fuel injection at acceleration while an air-conditioner is used.

In a known fuel injection system for a motor vehicle, a basic injection pulse width $T_p$ is calculated in dependence on an air flow Q, and engine speed N ($T_p=K\times Q/N$, where K is a constant). An actually injected injection pulse width $T_i$ is determined by correcting the basic injection pulse width $T_p$ in accordance with engine operating conditions such as idling and wide open throttle.

In order to compensate for response delay of an air-flow meter for detecting the air flow Q at the acceleration of the vehicle, Japanese Patent Laid Open No. 60-17247 discloses a control system wherein an auxiliary fuel is injected when a differential of pressure in an intake pipe is larger than a predetermined value, which indicates the acceleration of the engine. An auxiliary fuel injection pulse width $T_{ACC}$ for acceleration is obtained in dependence on a predetermined correction coefficient $K_{ACCL}$ for acceleration and correction constant $T_{CONST}$ ($T_{ACC}=K_{ACCLK}\times T_p+T_{CONST}$).

However, correction coefficient $K_{ACCL}$ and constant $T_{CONST}$ are set to have a proper air-fuel ratio under operating conditions without loads such as an air-conditioner. Accordingly, the power of the engine decreases when the air-conditioner is used. In order to maintain the same power, the driver of the vehicle depresses an accelerator pedal so that the opening degree of the throttle valve is increased to induct more air to increase the engine speed. The increase of the air flow Q causes an increase of the basic fuel injection pulse width $T_p$. However, since the coefficient $K_{ACCL}$ and the constant $T_{CONST}$ are set irrespective of the operation of the air-conditioner, auxiliary fuel injection pulse width $T_{ACC}$ also increases with increase of the engine speed. Thus, air-fuel mixture becomes excessively rich to reduce the combustion efficiency, thereby causing hesitation or stumble at the start and acceleration of the vehicle and hence decreasing the driveability.

SUMMARY OF THE INVENTION

The object of the present invention is to provide a fuel injection control system for controlling auxiliary fuel injection at the acceleration while using the air-conditioner to prevent the reduce of the combustion efficiency, thereby improving the driveability at the start and acceleration of the vehicle.

According to the present invention, there is provided a fuel injection control system for an automotive engine having an air-conditioner and a fuel injection system which produces an injection pulse width signal dependent on engine operating conditions.

The system comprises detector means for detecting acceleration of the engine and for producing an acceleration signal, an air-conditioner switch for producing an air-conditioner signal when air-conditioner switch is closed, auxiliary injection means responsive to the acceleration signal and air-conditioner signal for producing an auxiliary injection pulse width first signal which is injected at the acceleration signal is detected. The auxiliary injection pulse width first signal has a smaller value than a second signal when the air-conditioner switch is opened, thereby reducing auxiliary injection pulse width.

In an aspect of the invention, the system further comprises a neutral switch for producing a neutral signal when a transmission of a vehicle is in a neutral state, the auxiliary injection means being arranged to further respond to the neutral signal for producing an auxiliary injection pulse width third signal having a larger value than the second signal, thereby increasing the auxiliary injection pulse width. The auxiliary injection means has coefficients for correcting the auxiliary injection pulse width signal, and the coefficients decrease in value with increase of temperature of a coolant of the engine. The other objects and features of this invention will be apparently understood from the following description with reference to the accompanying drawings.

DETAILED DESCRIPTION OF THE PREFERRED EMBODIMENT

Figure 1:
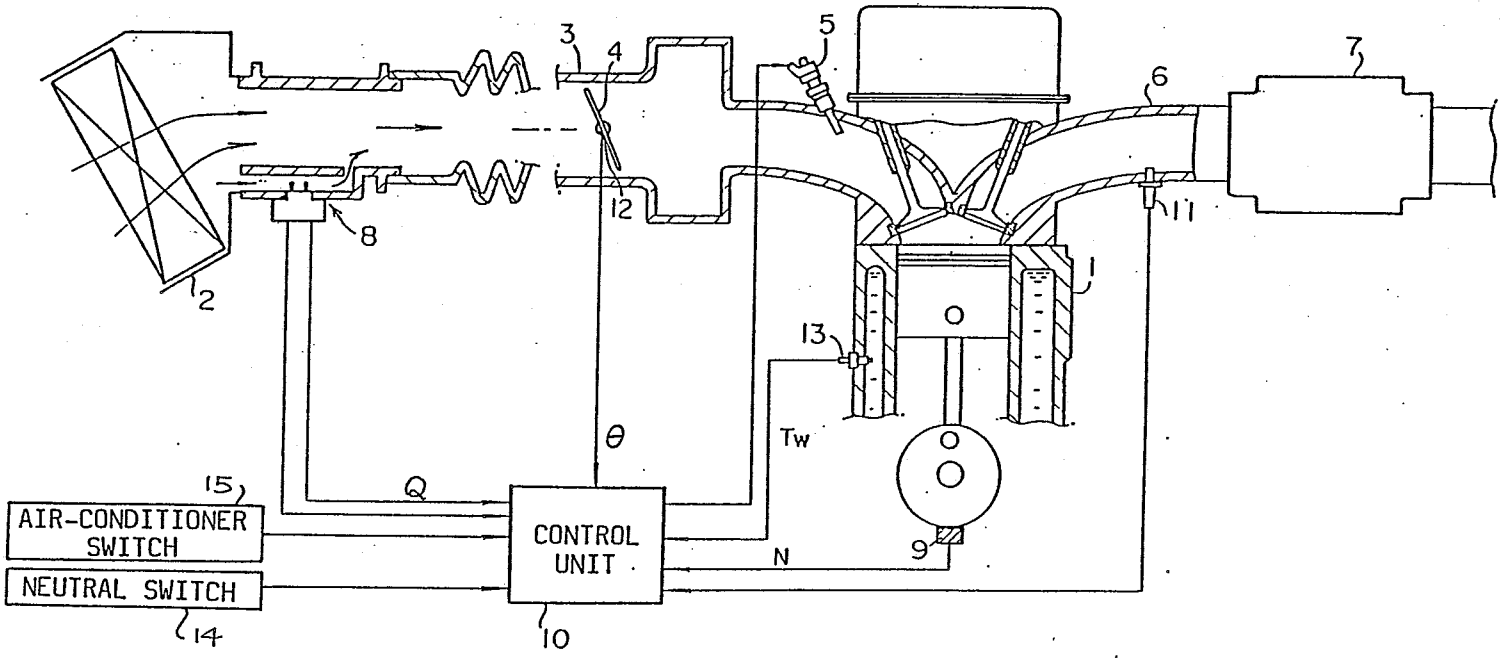
FIG. 1 is a schematic illustration showing a system for controlling the operation of an internal combustion engine for a motor vehicle.

Referring to FIG. 1, an internal combustion engine 1 for a motor vehicle is supplied with air through an air cleaner 2, intake pipe 3 and a throttle valve 4, mixing with fuel injected from an injector 5. Exhaust gas of the engine 1 is discharged through an exhaust pipe 6 and a catalytic converter 7. A mass air-flow meter 8 employing a hot wire is provided on the intake pipe 3 and an $O_2$-sensor 11 is mounted in the exhaust pipe 6. Output signals of the meter 8 and sensor 11 are applied to a control unit 10. The control unit 10 is also supplied with output signals of a crank angle sensor 9, throttle position sensor 12, coolant temperature sensor 13, neutral switch 14 for detecting the neutral state of a transmission (not shown), and air-conditioner switch 15. The control unit 10 produces an actuating signal to operate the injector 5.

Figure 2A:
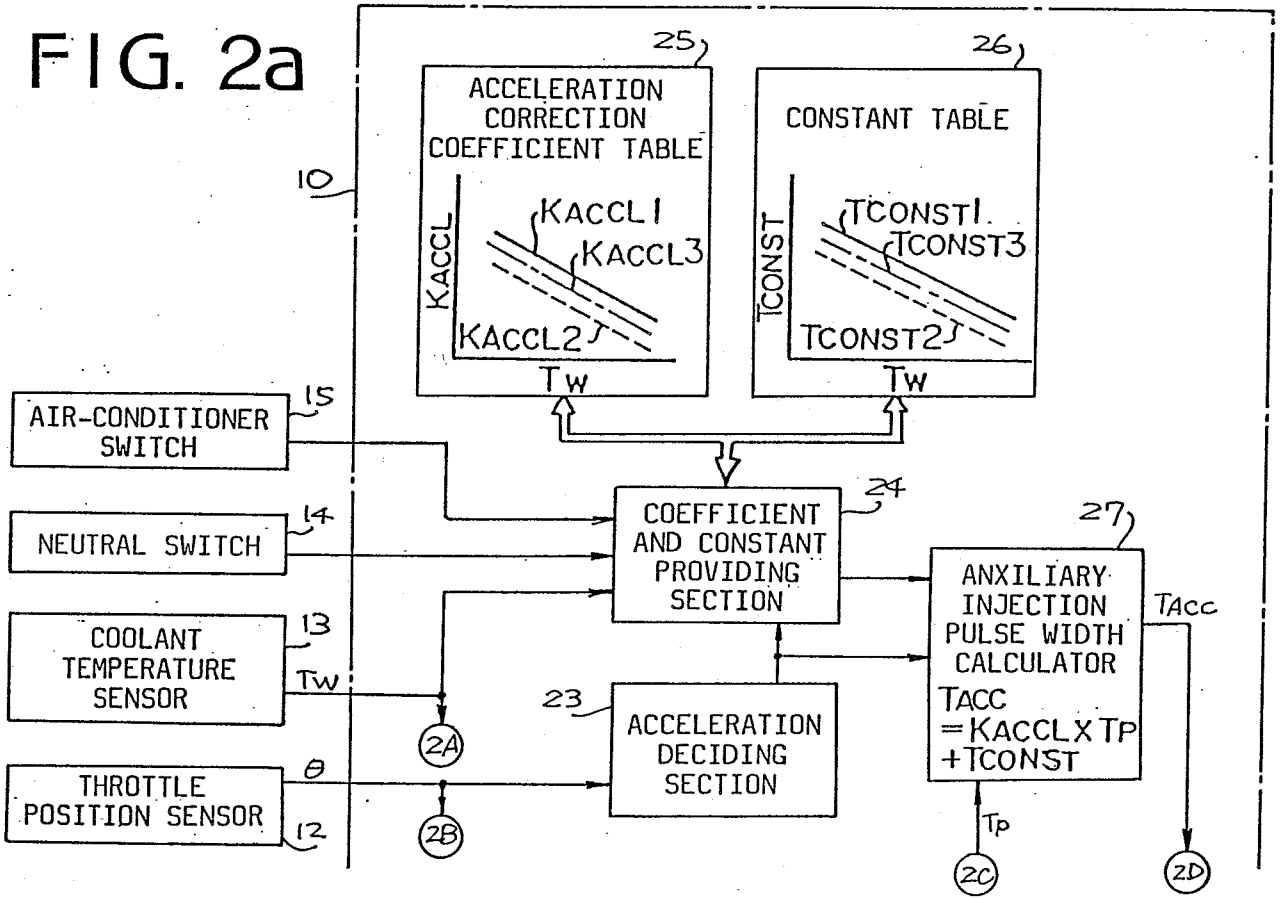
FIGS. 2*a* and 2*b* show a block diagram of a control unit used in a system of the invention.
Figure 2B:
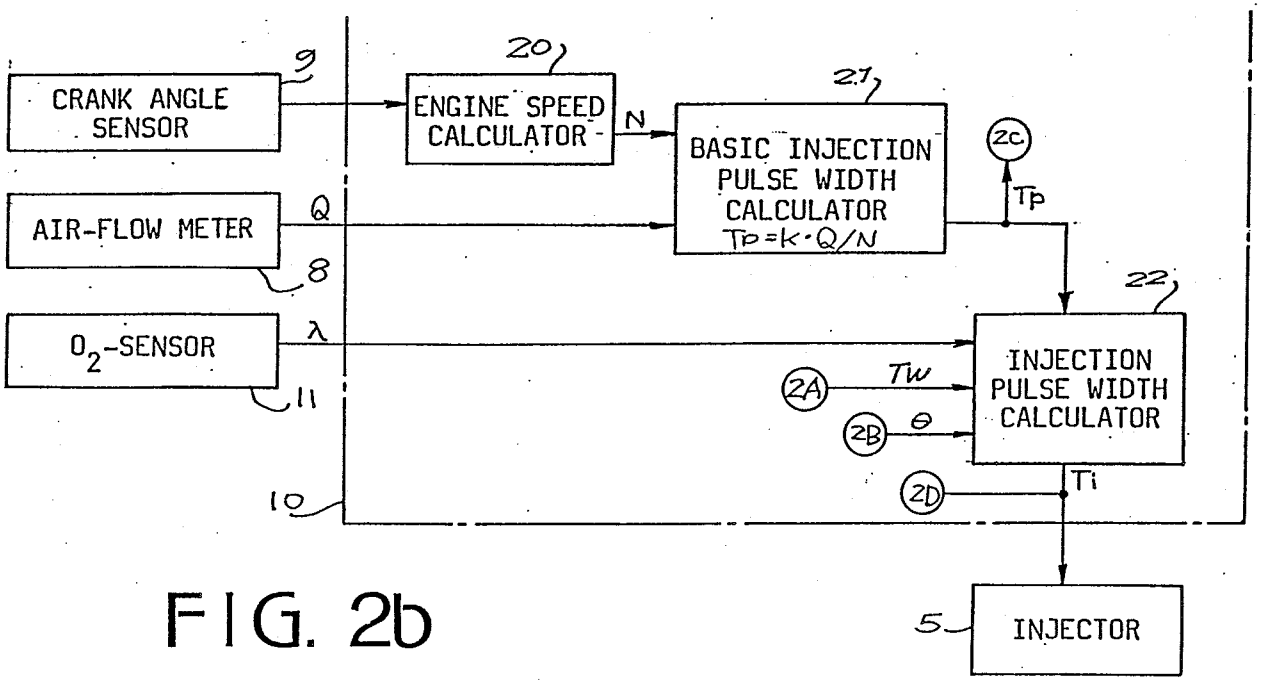

Referring to FIGS. 2*a* and 2*b*, the control unit 10 comprises an engine speed calculator 20 which calculates engine speed dependent on a signal from the crank angle sensor 9, and a basic injection pulse width calculator 21 to which an engine speed signal N from the engine speed calculator 20 and air flow signal Q from the mass air-flow meter 8 are applied. The basic injection pulse width $T_p$ is obtained by the following equation.

$$T_p=K\times Q/N \text{ (K is constant)}$$

The output signal $T_p$ is applied to an injection pulse width calculator 22 to obtain an injection pulse width $T_i$ by correcting the basic injection pulse width $T_p$ in accordance with a signal from $O_2$-sensor 11, coolant temperature signal $T_w$ from the coolant temperature sensor 13 and throttle position signal $\theta$ of the throttle position sensor 12. The injection pulse width $T_i$ is calculated by the following equation.

$$T_i = T_p \times COEF \times \lambda$$

where COEF is a miscellaneous coefficient comprising various correction or compensation coefficients obtained from memories dependent on coolant temperature, and throttle position, and $\lambda$ is a correcting coefficient dependent on the feedback signal of the $O_2$-sensor 11.

The control unit 10 further comprises an acceleration deciding section 23 which determines that the vehicle is accelerated when the throttle position signal $\theta$ representing the throttle opening degree changes at higher speed than a predetermined value. Output signals of the acceleration deciding section 23, neutral switch 14, air-conditioner switch 15 and coolant temperature signal $T_w$ are applied to an acceleration correction coefficient and constant providing section 24 having an acceleration correction coefficient memory 25 and a constant memory 26. The acceleration correction coefficient memory 25 comprises three lookup tables storing acceleration correction coefficients $K_{ACCL1}$, $K_{ACCL2}$ and $K_{ACCL3}$, respectively. The constant memory 26 comprises three lookup tables storing constants $T_{CONST1}$, $T_{CONST2}$ and $T_{CONST3}$, respectively. The coefficient table and the constant table are selected dependent on whether the neutral switch 14 and the air-conditioner switch 15 are closed or opened. The selection of the coefficient table and constant table are as follows.

| | AIR-CONDITIONER SWITCH | |
|---|---|---|
| NEUTRAL SWITCH | CLOSED | OPENED |
| CLOSED | $K_{ACCL1}$ $T_{CONST1}$ | $K_{ACCL1}$ $T_{CONST1}$ |
| OPENED | $K_{ACCL2}$ $T_{CONST2}$ | $K_{ACCL3}$ $T_{CONST3}$ |

Relationships among the coefficients $K_{ACCL1}$ to $K_{ACCL3}$ and among the constants $T_{CONST1}$ to $T_{CONST3}$ are as follows.

$$K_{ACCL1} > K_{ACCL3} > K_{ACCL2}$$

$$T_{CONST1} > T_{CONST3} > T_{CONST2}$$

Figure 3:
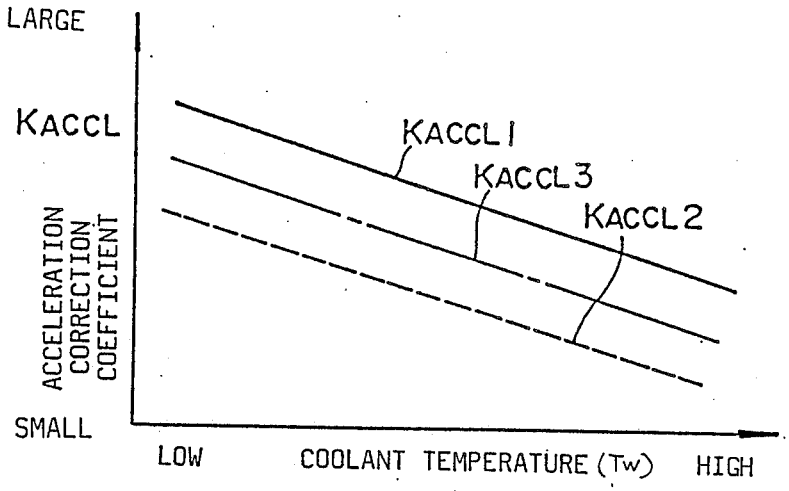
FIG. 3 is a graph showing a relationship between acceleration correction coefficient and coolant temperature.
Figure 4:
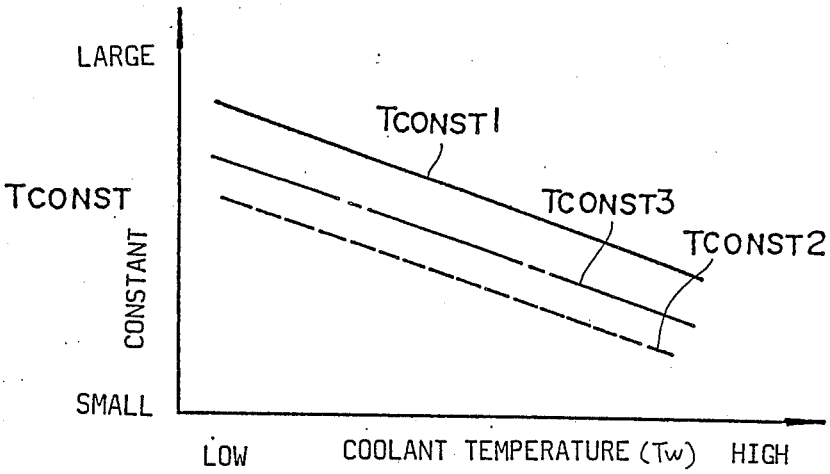
FIG. 4 is a graph showing a relationship between constant and coolant temperature.

An acceleration correction coefficient $K_{ACCL}$ and constant $T_{CONST}$ are respectively read out from the selected table in dependence on the coolant temperature. As shown in FIGS. 3 and 4, both the coefficient $K_{ACCL}$ and the constant $T_{CONST}$ decrease with the rise of the coolant temperature.

The derived correction coefficient $K_{ACCL}$ and constant $T_{CONST}$ are fed to an auxiliary injection pulse width calculator 27 to which basic injection pulse width $T_p$ and the acceleration signal from the acceleration deciding section 23 are supplied. The equation for obtaining auxiliary injection pulse width $T_{ACC}$ is as follows.

$$T_{ACC} = K_{ACCL} \times T_p + T_{CONST}$$

Injection pulse widths $T_i$ and $T_{ACC}$ are independently fed to the injector 5, respectively.

Figure 5:
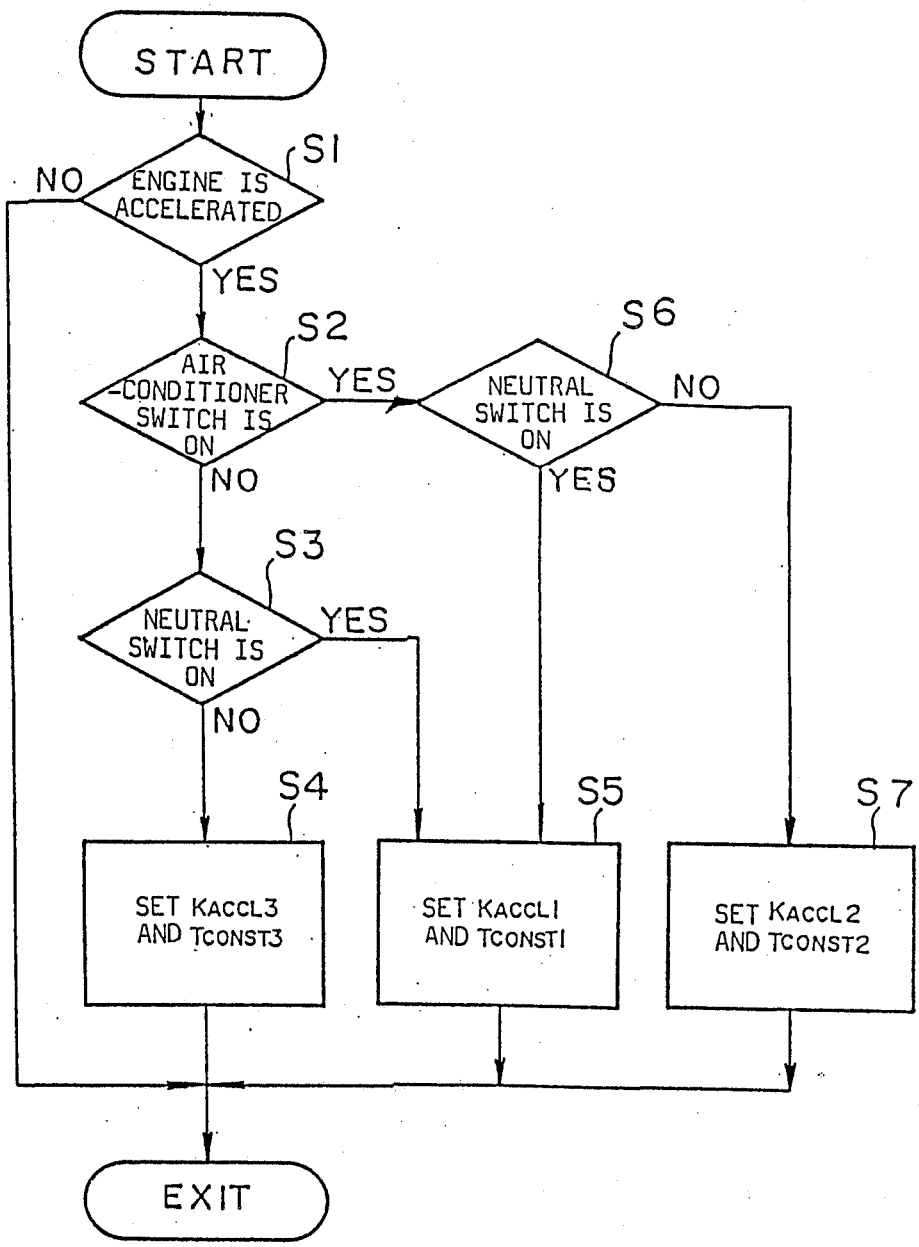
FIG. 5 is a flowchart showing the operation of the system of the present invention.

The operation of the present invention is described hereafter with reference to the flowchart shown in FIG. 5.

At a step S1, it is determined that the engine is accelerated when the changing rate of the opening degree of the throttle valve for a predetermined period, for example 40 msec., is larger than a predetermined value. If the acceleration is determined, the program proceeds to a step S2 where it is determined whether the air-conditioner switch is on or off. When the air conditioner switch is off, it is further determined at a step S3 whether the neutral switch is on. When the neutral switch is off, which means that the vehicle is being accelerated, an acceleration correction coefficient $K_{ACCL3}$ and a constant $T_{CONST3}$ are derived and set at a step S4.

On the other hand, when it is determined at the step S3 that the neutral switch is on, which means that accelerator pedal is depressed during idling (racing), correction coefficient $K_{ACCL1}$ and constant $T_{CONST1}$ are set at a step 5.

When it is determined that the air-conditioner switch is on at the step S2, the program proceeds to a step S6 where it is also determined whether the neutral switch is on. When the neutral switch is on, the program goes to the step S5. When it is determined that the neutral switch is off at step S6, acceleration correction coefficient $K_{ACCL2}$ and constant $T_{CONST2}$ are set at a step S7. At each step, the acceleration correcting coefficient and the constant are read out in dependence on the coolant temperature signal $T_w$.

Since the values of the coefficient $K_{ACCL2}$ and the constant $T_{CONST2}$ are the smallest, the auxiliary injection pulse width $T_{ACC}$ becomes small. Accordingly, at acceleration of the vehicle while the air-conditioner is used, that is when the neutral switch is off and the air-conditioner switch is closed, the air-fuel mixture is prevented from becoming excessively rich.

In addition, when the coolant temperature is low, the values of the coefficient and constant are large so that the auxiliary pulse width is increased.

In accordance with the present invention, the correction coefficient and constant at the acceleration of the vehicle is decreased while the air-conditioner is used. Therefore, the fuel quantity for a predetermined time is determined to a value same as that of a state while the air-conditioner is not used, in spite of the increase in basic fuel injection pulse width. Thus, the air-fuel mixture is prevented from becoming over-rich.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. A fuel injection control system for an automotive engine having an air-conditioner and a fuel injection system which produces an injection pulse width signal for main fuel injection, the system comprising:

detector means for detecting acceleration of the engine and for producing an acceleration signal;

an air-conditioner switch for producing an air-conditioner signal when the air-conditioner switch is closed;

auxiliary injection means responsive to the acceleration signal and air-conditioner signal for producing an auxiliary injection pulse width first signal which is injected independent of the main fuel injection, the auxiliary injection pulse width first signal having a smaller value than a second signal when the air-conditioner switch is opened, thereby reducing auxiliary injection pulse width.

2. The system according to claim 1 further comprising a neutral switch for producing a neutral signal when a transmission of a vehicle is in a neutral state, the auxiliary injection means being arranged to further respond to the neutral signal for producing an auxiliary injection pulse width third signal having a larger value than the second signal, thereby increasing the auxiliary injection pulse width.

3. The system according to claim 1 wherein the auxiliary injection means has coefficients for correcting the auxiliary injection pulse width signal.

4. The system according to claim 3 wherein the coefficients decrease in value with increase of temperature of a coolant of the engine.

* * * * *